US005517002A

United States Patent [19]

Higgins

[11] Patent Number: 5,517,002

[45] Date of Patent: May 14, 1996

[54] RADIANT ELECTRIC HEATER

[75] Inventor: George A. Higgins, Stourbridge, United Kingdom

[73] Assignee: Ceramaspeed Limited, United Kingdom

[21] Appl. No.: 398,921

[22] Filed: Mar. 6, 1995

[30] Foreign Application Priority Data

Mar. 9, 1994 [GB] United Kingdom ..... 9404507

[51] Int. Cl.[6] ..... H05B 3/68

[52] U.S. Cl. ..... 219/465; 219/443

[58] Field of Search ..... 219/446, 443, 219/445, 457–459, 462–463, 464–468, 453, 506

[56] References Cited

U.S. PATENT DOCUMENTS 4,713,527 12/1987 Kicherer ..... 219/464
4,794,233 12/1988 Goessler ..... 219/464
5,204,510 4/1993 McWilliams ..... 219/464
5,270,519 12/1993 Higgins ..... 219/464

*Primary Examiner*—Teresa J. Walberg
*Assistant Examiner*—Sam Paik
*Attorney, Agent, or Firm*—Ira S. Dorman

[57] ABSTRACT

A radiant heater for a glass ceramic top cooking appliance includes a base of thermal and electrical insulating material and at least first and second heating elements arranged such that at least the first heating element provided in a first heating zone is adjacent to at least the second heating element provided in a second heating zone, the first heating element comprising a bright radiating element. A peripheral wall of thermal insulating material surrounds the heating elements and a dividing wall is arranged between the first and second heating elements and extends to a height substantially the same as that of the peripheral wall. A plurality of passages communicates between the first and second heating zones and is disposed in the region of the base of the dividing wall such that, when the bright radiating element is energized, light from the bright radiating element laterally illuminates the second heating zone through the passages.

24 Claims, 2 Drawing Sheets

RADIANT ELECTRIC HEATER

This invention relates to a radiant electric heater for a cooking appliance with a glass ceramic top.

DESCRIPTION OF PRIOR ART

Radiant heaters are known, for example from GB-A-2 044 057, having at least two heating elements supported on a base of thermal and electrical insulating material, such as microporous insulating material, with a first heating element in a first heating zone adjacent to a second heating element in a second heating zone. The first heating element may particularly extend substantially around the periphery of the second heating element. A dividing wall, usually of a thermally insulating material, is arranged between the first and second heating elements and extends substantially up to the glass ceramic top, thereby defining first and second heating zones. A peripheral wall of thermal insulating material usually surrounds the heater and contacts the glass ceramic top. The dividing wall and the peripheral wall can be provided integral with or separate from the insulating base. The first and second heating elements can be energised independently or together according to heating requirements.

It is also known, for example from EP-A-0 343 868, to provide one or more of the heating elements as a bright radiating element. Such a bright radiating element usually comprises a halogen lamp, but may alternatively comprise a molybdenum disilicide element. It emits bright visible white light in contrast with other well known forms of radiant heating element comprising a coiled wire or an electrically conductive strip or ribbon, which emit visible radiation mainly in the red region of the spectrum.

When a bright radiating element is provided in the first heating zone of a heater, then if this bright radiating element is energised either with or without the element in the second heating zone being energised, the heater when viewed through the glass ceramic top exhibits a relatively dark zone adjacent to the bright zone as a result of the presence of the dividing wall. From an aesthetic point of view this is sometimes unacceptable particularly when the bright zone surrounds the relatively dark zone, there being a preference for bright visible illumination of the inner zone also in order to avoid strong contrasts of illumination between the two zones.

If an attempt is made to overcome this problem by removing the dividing wall, or lowering it over at least a part of its length as described in DE-A-3 817 113, this introduces a further disadvantage in that, although light from the bright radiating element is then able to illuminate the inner zone, heat is also able to be transmitted between the zones. This is particularly disadvantageous when it is desired to operate the inner heating zone alone to heat a small cooking utensil placed over it. Escape of heat from the inner zone to the outer zone in this situation increases the time required to heat the contents of the cooking utensil to its desired temperature.

OBJECT OF THE INVENTION

It is an object of the present invention to reduce or substantially eliminate the transmission of heat between the two zones of a heater while permitting the passage of light.

SUMMARY OF THE INVENTION

The present invention provides a radiant electric heater for a glass ceramic top cooking appliance, the heater comprising:

a base of thermal and electrical insulating material;

at least first and second heating elements arranged such that at least the first heating element provided in a first heating zone is adjacent to at least the second heating element provided in a second heating zone, the first heating element comprising a bright radiating element;

a peripheral wall of thermal insulating material surrounding the heating elements; and a dividing wall arranged between the first and second heating elements and extending to a height substantially the same as that of the peripheral wall, wherein a plurality of passages communicates between the first and second heating zones and is disposed in the region of the base of the dividing wall such that, when the bright radiating element is energised, light therefrom laterally illuminates the second heating zone through the passages.

The presence of the passages in the region of the base of the dividing wall, for example laterally adjacent to the bright radiating element, allows illumination by the bright radiating element of the adjacent heating zone, whilst providing the least favourable conditions for heat flow by convection between the zones through the passages due to the provision of the passages at or near the base of the dividing wall.

In a particularly advantageous embodiment, the at least first heating element in the first heating zone extends substantially around the periphery of the at least second heating element provided in the second heating zone.

The bright radiating element may comprise a halogen lamp or a molybdenum disilicide element.

The second heating element suitably comprises a coiled wire heating element or a heating element of electrically conductive strip or ribbon form.

The passages may comprise a plurality of openings through the dividing wall at or near the base thereof. Such openings may comprise slots in the base of the dividing wall or holes through the dividing wall, for example laterally adjacent to the bright radiating element.

Alternatively the base of thermal and electrical insulating material may be provided on its surface with a plurality of pedestals, integral therewith or secured thereto, the dividing wall being supported on the pedestals, the passages communicating between the first and second heating zones being formed by gaps between the underside of the dividing wall and the base of insulating material between the pedestals.

If desired, the base of insulating material in those regions between the pedestals may have a surface which slopes upwards along the passages from beneath the bright radiating element towards the second heating zone. This increases the amount of incident light in the passages.

The dividing wall may be provided separate from or integral with the insulating base and suitably comprises a thermal insulating material. It may be formed, for example, from bound ceramic fibre or glass bound filament material, or from bound micaceous material such as vermiculite, or from microporous insulating material.

The base of thermal and electrical insulating material may suitably comprise a microporous thermal and electrical insulating material.

The second heating zone may contain one or more further heating elements if required in addition to the second heating element.

The first heating zone may contain one or more further heating elements in addition to the bright radiating element.

The invention is now described by way of example with reference to the accompanying drawings in which:

DESCRIPTION OF PREFERRED EMBODIMENTS

Figure 1:
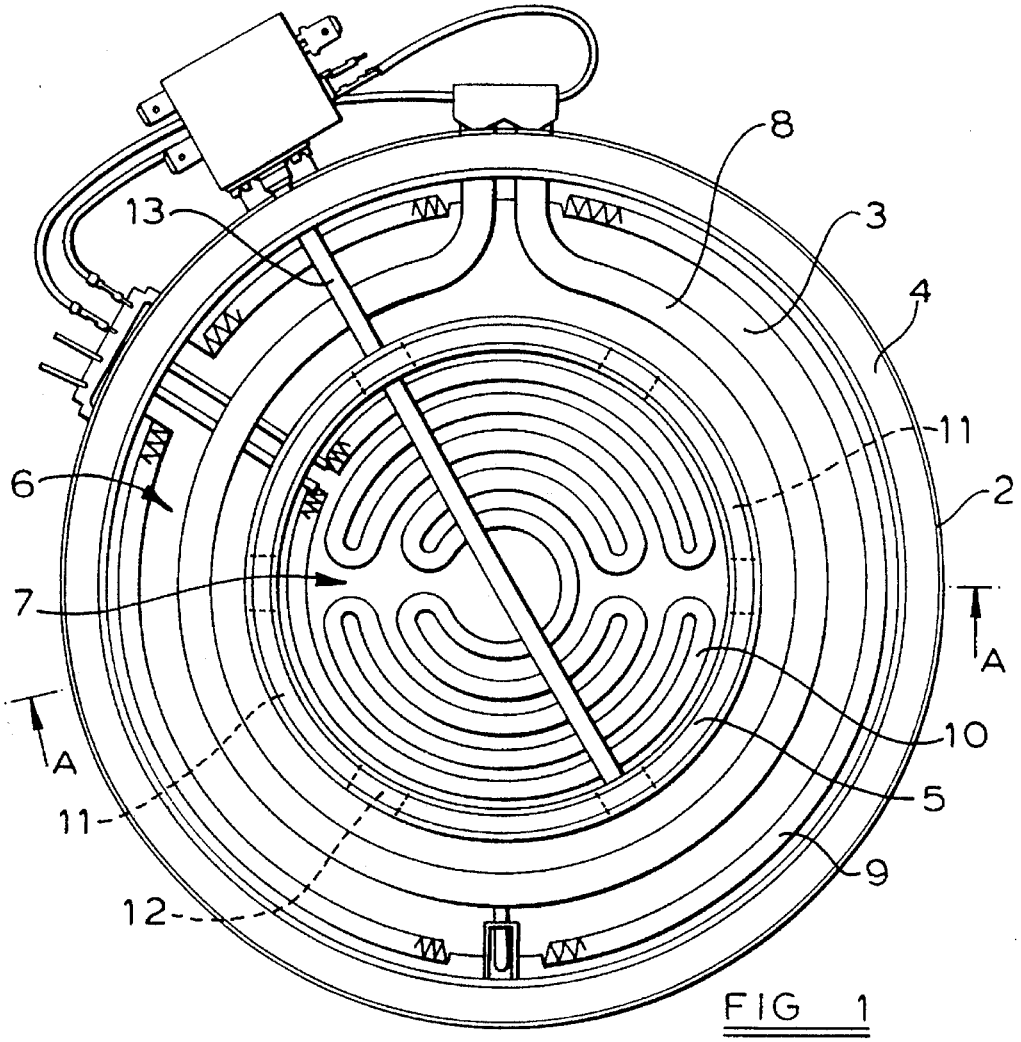
FIG. 1 is a top plan view of one embodiment of a radiant electric heater according to the invention.
Figure 2:
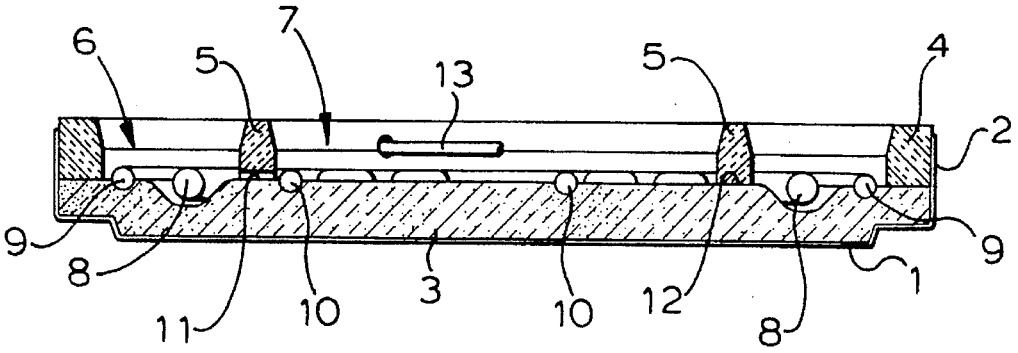
FIG. 2 is a sectional view of the heater of FIG. 1 taken along the line A—A in FIG. 1.

A radiant electric heater 1 shown in FIGS. 1 and 2 has a container in the form of a metal dish 1 with an upstanding rim 2 and containing a layer of electrical and thermal insulating material 3. This material is, for example, a microporous insulating material which comprises a silica aerogel powder mixed with a reinforcing fibre or filament material, titanium dioxide opacifier and a small quantity of alumina powder to provide resistance to shrinking at high temperatures. The insulating material 3 is pressed into the dish 1. A ring-shaped peripheral wall 4 comprising, for example, ceramic fibres or bound vermiculite or microporous insulating material extends around the inside of the rim 2 of the dish 1, on top of the layer 3 and protruding slightly above the edge of the rim 2. When the heater is installed in a glass ceramic top cooker, the wall 4 is pressed against the underside of a glass ceramic cooking surface (not shown) of well known form.

A ring-shaped dividing wall 5, of similar construction to the peripheral wall 4, is provided, supported on the insulating layer 3. As with the peripheral wall, the dividing wall also extends up to the underside of the glass ceramic cooking surface. This wall 5 serves to divide the heater into two separate concentric heating zones, a first heating zone 6 surrounding a second, or inner, heating zone 7.

A bright radiating first heating element 8, comprising a generally circular tungsten-halogen lamp of well known form, is supported on the layer 3 in the first heating zone 6. A coiled wire electrical heating element 9 of well known form is also supported on the layer 3 and may be arranged to be electrically connected in series with the lamp 8 to act as ballast to damp the inrush current in the lamp when the lamp is energised, such an arrangement being very well known. Instead of the bright radiating heating element 8 comprising a tungsten-halogen lamp it could, for example, comprise a molybdenum disilicide electrical heating element which heats to incandescence when in operation.

A second heating element 10, of known coiled wire form, or of electrically conductive strip or ribbon form, is supported on the insulating layer 3 in the second, or inner, heating zone 7.

The first and second heating elements 8, 10 are arranged to be electrically connectable such that they can be energised independently or together.

The bright radiating first heating element 8 emits bright visible light, in addition to infra-red heat radiation, when in operation, whereas the second heating element 10 emits duller visible radiation in the red region of the spectrum, in addition to infra-red heat radiation. Even though the glass ceramic material is dark in colour it is translucent and this means that, when the two heating zones are both energised, the heater is observed through the glass ceramic top as a bright circle of light in the first heating zone 6 surrounding a relatively dark inner second heating zone 7. This can be aesthetically unsatisfactory. If the dividing wall 5 were to be removed, or lowered, or provided with channels in its top surface, this would allow light from the bright radiating element 8 to illuminate the inner zone, which would be aesthetically more pleasing. However, this would be disadvantageous from a thermal point of view. It may be required to operate the heater with only the inner heating zone 7 in operation, that is with only the heating element 10 energised, and with a small cooking utensil on the glass ceramic top covering substantially only the inner heating zone 7. In the absence of the dividing wall 5, or with the provision of a lower dividing wall 5 over at least a part of its length, or a wall with channels in its top surface, substantial heat would escape from the inner heating zone 7 into the first, or outer, heating zone 6. As a result, the time for a particular cooking operation to be performed in the cooking utensil located over the inner heating zone 7 would be significantly increased. Such a loss of efficiency is undesirable.

Figure 3:
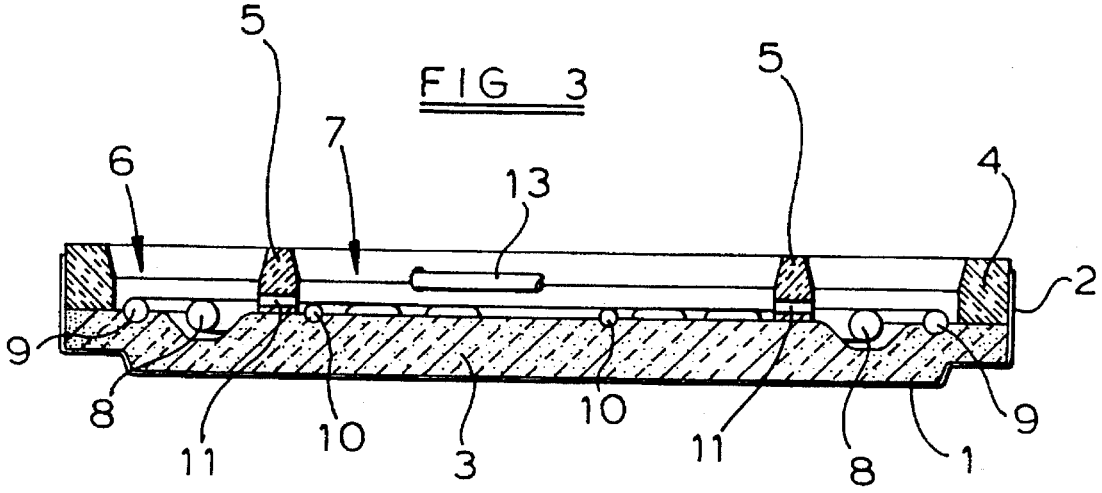
FIG. 3 is a sectional view, similar to the view in FIG. 2, of another embodiment of a radiant electric heater according to the present invention.

In the heater according to the invention this problem is overcome by retaining the dividing wall 5, but providing a plurality of passages 11 in the region of the base of the dividing wall substantially laterally adjacent to the bright radiating heating element 8 and communicating between the heating zones 6 and 7. In one embodiment, as shown in FIGS. 1 and 2, the passages 11 comprise a plurality of openings through the dividing wall 5 at the base thereof. Such openings forming the passages 11 are formed as slots in the base of the dividing wall between regions 12 where no slots are provided. Alternatively, as shown in FIG. 3, the passages may comprise holes of any desired shape in the dividing wall 5. It is to be understood, however, that the dividing wall 5 could be formed as an integral part of the insulating base layer 3, in which case the passages 11 would then always be provided as holes through the region of the base of the dividing wall laterally adjacent to the bright radiating element 8.

Figure 4:
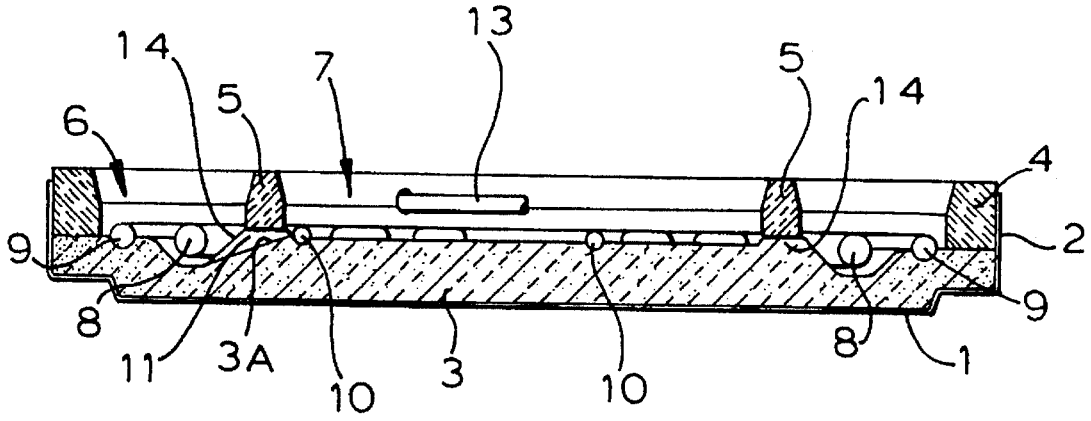
FIG. 4 is a sectional view, similar to the view in FIG. 2, of a further embodiment of a radiant electric heater according to the present invention.

In an alternative embodiment, shown in FIG. 4, the base layer 3 of insulating material is provided on its surface with a plurality of pedestals 14, either formed integrally with the layer 3, such as by co-moulding therewith, or provided separately and secured to the surface of the layer 3. The dividing wall 5 is supported on the pedestals 14 such that passages 11, laterally adjacent to the bright radiating element 8 and communicating between the heating zones 6 and 7, are formed by gaps between the underside of the dividing wall 5 and regions 3A of the base layer of insulating material between the pedestals 14. The regions 3A of the base layer of insulating material between the pedestals 14 may have a surface which slopes upwards along the passages 11 from beneath the bright radiating element towards the inner heating zone.

The illustrated embodiments of the invention operate as follows. When the bright radiating heating element 8 is in operation in the outer heating zone 6, with or without accompanying operation of the heating element 10 in the inner heating zone 7, light from the element 8 illuminates the inner heating zone 7 through the passages 11 and reduces undesirable contrast between the levels of illumination in the two zones when viewed through the glass ceramic cook top. However, the positioning of the passages 11 at or near the base of the interior of the heater, laterally adjacent to the bright radiating element results in insignificant transmission of heat between the zones 6 and 7 through the passages 11, particularly by convection.

The transmission of heat between the zones 6 and 7 has been confirmed by tests in which a utensil containing water was located on the glass ceramic cook top, covering only the inner heating zone 7 of the heater. The time taken to heat the water to boiling point with only the inner heating element 10 energised was compared for the heater with and without the passages 11 in the dividing wall 5. No significant difference in time was observed. By contrast, when, instead of the passages 11, channels of similar cross sectional area to the passages were provided at the top of the dividing wall 5, the water was found to take at least half a minute longer to reach boiling point.

As is customary with heaters for glass ceramic top cookers, a thermal cut-out device 13 is provided extending across the heater to switch off the heating elements to avoid over-heating of the glass ceramic cooking surface when the heater is installed and operating in a cooking appliance having such a glass ceramic cooking surface.

Other embodiments of the invention may be envisaged within the scope thereof. For example, the heating elements in the heating zones 6, 7 could be interchanged, the bright radiating element 8 then being located in the inner zone 7 and the other element 10 then being in the outer zone 6. In such an arrangement light from the bright radiating element 8 would illuminate the outer heating zone through the passages 11.

Further heating elements could also be provided in the heating zones 6 and 7 in addition to the elements 8 and 10, the provision of such further elements being well known to the skilled person.

I claim:

1. A radiant electric heater for a glass ceramic top cooking appliance, the heater comprising:

a base of thermal and electrical insulating material;

at least first and second heating elements arranged such that at least the first heating element provided in a first heating zone is adjacent to at least the second heating element provided in a second heating zone, the first heating element comprising a bright radiating element;

a peripheral wall of thermal insulating material surrounding the heating elements; and a dividing wall arranged between the first and second heating elements and extending to a height substantially the same as that of the peripheral wall, wherein the dividing wall has a base portion through which extend a plurality of passages communicating between the first and second heating zones such that, when the bright radiating element is energised, light therefrom laterally illuminates the second heating zone through the passages, and wherein the first heating element in the first heating zone extends substantially around the periphery of the second heating element provided in the second heating zone.

2. A heater according to claim 1, wherein the bright radiating element comprises a halogen lamp or a molybdenum disilicide element.

3. A heater according to claim 1, wherein the second heating element comprises a coiled wire heating element or a heating element of electrically conductive ribbon form.

4. A heater according to claim 1, wherein the passages comprise a plurality of openings through the dividing wall at or near the base thereof.

5. A heater according to claim 4, wherein the openings comprise slots in the base of the dividing wall.

6. A heater according to claim 5, wherein the slots are provided laterally adjacent to the bright radiating element.

7. A heater according to claim 4, wherein the openings comprise holes through the dividing wall.

8. A heater according to claim 7, wherein the holes are provided laterally adjacent to the bright radiating element.

9. A heater according to claim 1, wherein the base of thermal and electrical insulating material is provided on its surface with a plurality of pedestals, the dividing wall being supported on the pedestals, the passages communicating between the first and second heating zones being formed by gaps between the underside of the dividing wall and the base of insulating material between the pedestals.

10. A heater according to claim 9, wherein the base of insulating material in those regions between the pedestals has a surface which slopes upwards along the passages from beneath the bright radiating element towards the second heating zone.

11. A heater according to claim 1, wherein the dividing wall comprises a thermal insulating material.

12. A heater according to claim 11, wherein the thermal insulating material is selected from the group consisting of bound ceramic fibre material, bound glass filament material, bound micaceous material and microporous insulating material.

13. A heater according to claim 12, wherein the micaceous material comprises vermiculite.

14. A heater according to claim 1, wherein the base of thermal and electrical insulating material comprises a microporous thermal and electrical insulating material.

15. A heater according to claim 1, wherein the first heating zone contains one or more further heating elements in addition to the bright radiating element.

16. A radiant electric heater for a glass ceramic top cooking appliance, the heater comprising;

a base of thermal and electrical insulating material;

at least first and second heating elements arranged such that at least the first heating element provided in a first heating zone is adjacent to at least the second heating element provided in a second heating zone, the first heating element comprising a bright radiating element;

a peripheral wall of thermal insulating material surrounding the heating elements;

a dividing wall arranged between the first and second heating elements and extending to a height substantially the same as that of the peripheral wall; and a plurality of pedestals provided on the surface of the base of thermal and electrical insulating material, the dividing wall being supported on the pedestals, wherein a plurality of passages are formed by gaps between the underside of the dividing wall and the base of insulating material between the pedestals, the passages communicating between the first and second heating zones such that, when the bright radiating element is energised, the light therefrom laterally illuminates the second heating zone through the passages.

17. A heater according to claim 16, wherein the base of insulating material in those regions between the pedestals has a surface which slopes upwards along the passages from beneath the bright radiating element towards the second heating zone.

18. A heater according to claim 16, wherein the bright radiating element comprises a halogen lamp or a molybdenum disilicide element.

19. A heater according to claim 16, wherein the second heating element comprises a coiled wire heating element or a heating element of electrically conductive ribbon form.

20. A heater according to claim 16, wherein the dividing wall comprises a thermal insulating material.

21. A heater according to claim 20, wherein the thermal insulating material is selected from the group consisting of bound ceramic fibre material, bound glass filament material, bound micaceous material and microporous insulating material.

22. A heater according to claim 21, wherein the micaceous material comprises vermiculite.

23. A heater according to claim 16, wherein the base of thermal and electrical insulating material comprises a microporous thermal and electrical insulating material.

24. A heater according to claim 16, wherein the first heating zone contains one or more further heating elements in addition to the bright radiating element.

* * * * *